US011791583B2

(12) United States Patent
Iwasaki et al.

(10) Patent No.: US 11,791,583 B2
(45) Date of Patent: Oct. 17, 2023

(54) CONNECTOR WITH TERMINAL FITTING AND RESTRICTING PORTION

(71) Applicant: SUMITOMO WIRING SYSTEMS, LTD., Mie (JP)

(72) Inventors: Yune Iwasaki, Mie (JP); Masakazu Suzuki, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 100 days.

(21) Appl. No.: 17/503,799

(22) Filed: Oct. 18, 2021

(65) Prior Publication Data

US 2022/0131302 A1 Apr. 28, 2022

(30) Foreign Application Priority Data

Oct. 26, 2020 (JP) ..... 2020-179028

(51) Int. Cl.

| | |
|---|---|
| ***H01R 13/436*** | (2006.01) |
| ***H01R 13/639*** | (2006.01) |
| ***H01R 13/629*** | (2006.01) |
| ***H01R 13/50*** | (2006.01) |

(52) U.S. Cl.

CPC ..... *H01R 13/4361* (2013.01); *H01R 13/501* (2013.01); *H01R 13/629* (2013.01); *H01R 13/639* (2013.01)

(58) Field of Classification Search

CPC . H01R 13/4361; H01R 13/501; H01R 13/629
See application file for complete search history.

(56) References Cited

U.S. PATENT DOCUMENTS

| | | | | |
|---|---|---|---|---|
| 4,690,477 | A * | 9/1987 | Doutrich | H01R 13/422 439/747 |
| 5,520,553 | A * | 5/1996 | Cecil, Jr. | H01R 13/4368 439/595 |
| 5,860,834 | A | 1/1999 | Sugiyama | |
| 5,947,775 | A * | 9/1999 | Yamamoto | H01R 13/501 439/752 |
| 6,024,605 | A | 2/2000 | Beck, Jr. et al. | |
| 6,328,614 | B1 * | 12/2001 | Osawa | H01R 13/4361 439/752 |

(Continued)

FOREIGN PATENT DOCUMENTS

| | | |
|---|---|---|
| JP | H07-029760 U | 6/1995 |
| JP | 2017-199597 A | 11/2017 |

*Primary Examiner* — Neil Abrams
(74) *Attorney, Agent, or Firm* — Venjuris, P.C.

(57) ABSTRACT

A connector includes a terminal fitting, a housing body, a retainer portion and a hinge portion. The housing body accommodates the terminal fitting. The retainer portion openably and closably rotate with respect to the housing body. The hinge portion is coupled to the retainer portion and the housing body and constitutes a rotation center axis of the retainer portion. The housing body includes a cavity configured to accommodate the terminal fitting inside and a locking lance projecting into the cavity to lock the terminal fitting. The retainer portion includes a restricting portion configured to restrict rearward escape of the terminal fitting by projecting into the cavity when the retainer portion is in a closed state with respect to the housing body, and a front wall arranged in front of the locking lance in the closed state.

7 Claims, 9 Drawing Sheets

(56) References Cited

U.S. PATENT DOCUMENTS

| | | | | |
|---|---|---|---|---|
| 6,354,873 | B1 * | 3/2002 | Morello | H01R 13/4362 439/352 |
| 6,755,688 | B2 * | 6/2004 | Hall | H01R 13/4364 439/595 |
| 9,893,467 | B2 * | 2/2018 | Chen | H01R 13/426 |
| 11,456,553 | B2 * | 9/2022 | Soh | H01R 43/20 |
| 2022/0131302 | A1 * | 4/2022 | Iwasaki | H01R 13/4361 |

* cited by examiner

CONNECTOR WITH TERMINAL FITTING AND RESTRICTING PORTION

CROSS-REFERENCE TO RELATED APPLICATIONS

This application is based on and claims priority from Japanese Patent Application No. 2020-179028, filed on Oct. 26, 2020, with the Japan Patent Office, the disclosure of which is incorporated herein in their entireties by reference.

TECHNICAL FIELD

The present disclosure relates to a connector.

BACKGROUND

Japanese Patent Laid-open Publication Nos. 2017-199597, H07-029760, H09-063682 and H11-238545 disclose a connector for accommodating a female terminal fitting. Particularly, the connector of Japanese Patent Laid-open Publication No. 2017-199597 includes a housing and a front member. The housing includes a cavity for accommodating the terminal fitting and a locking lance for retaining the terminal fitting accommodated in the cavity. The front member can protect the locking lance of the housing by being mounted on a front side of the housing.

SUMMARY

However, in the connector of Japanese Patent Laid-open Publication No. 2017-199597, the front member, which is a member separate from the housing, is necessary to protect the locking lance. Thus, there is a problem of increasing the number of components.

Accordingly, the present disclosure aims to provide a connector capable of protecting a locking lance while suppressing an increase in the number of components.

The present disclosure is directed to a connector with a terminal fitting, a housing body configured to accommodate the terminal fitting, a retainer portion configured to openably and closably rotate with respect to the housing body, and a hinge portion coupled to the retainer portion and the housing body, the hinge portion constituting a rotation center axis of the retainer portion, wherein the housing body includes a cavity configured to accommodate the terminal fitting inside and a locking lance projecting into the cavity to lock the terminal fitting, and the retainer portion includes a restricting portion configured to restrict rearward escape of the terminal fitting by projecting into the cavity when the retainer portion is in a closed state with respect to the housing body, and a front wall arranged in front of the locking lance in the closed state.

According to the present disclosure, a locking lance can be protected while an increase in the number of components is suppressed.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
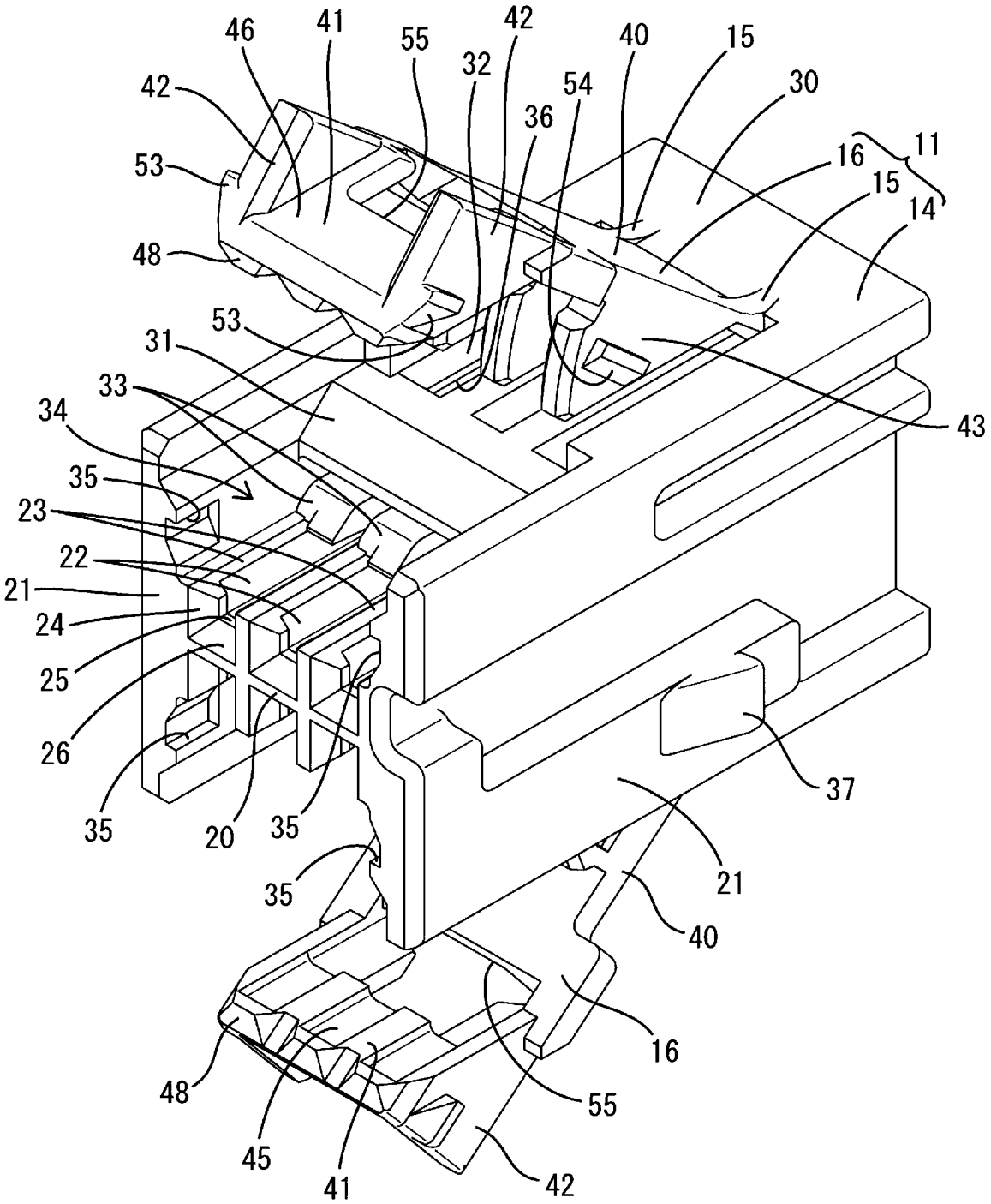
FIG. 1 is a perspective view of housing in an open state in one embodiment.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

Description of Embodiments of Present Disclosure

First, embodiments of the present disclosure are listed and described.

(1) The connector of the present disclosure includes a terminal fitting, a housing body configured to accommodate the terminal fitting, a retainer portion configured to openably and closably rotate with respect to the housing body, and a hinge portion coupled to the retainer portion and the housing body, the hinge portion constituting a rotation center axis of the retainer portion, wherein the housing body includes a cavity configured to accommodate the terminal fitting inside and a locking lance projecting into the cavity to lock the terminal fitting, and the retainer portion includes a restricting portion configured to restrict rearward escape of the terminal fitting by projecting into the cavity when the retainer portion is in a closed state with respect to the housing body, and a front wall arranged in front of the locking lance in the closed state.

According to this configuration, since the locking lance can be protected by the front wall of the retainer portion, a front holder for protecting the locking lance can be omitted. That is, the retainer portion can not only function to restrict the escape of the terminal fitting, but also function to protect the locking lance. Further, since the retainer portion is coupled to the housing body via the hinge portion, the configuration of the entire connector can be simplified. Further, according to this configuration, the front wall of the retainer portion is arranged at a position overlapping the locking lance in the closed state when viewed from front. Thus, a width or height of the connector can be suppressed to be small, with the result that the connector can be reduced in size.

(2) Preferably, the housing body includes an opening configured to open the cavity on a side surface of an outer periphery, and the front wall has, on a rear surface, an inner slope inclined with respect to a front-rear direction while closing the opening in the closed state.

According to this configuration, the opening of the housing body can be closed by the inner slope of the front wall, with the result that the locking lance projecting into the cavity can be protected. Further, since the inner slope is inclined with respect to the front-rear direction, a movable range of a tip side of the terminal fitting arranged inside the cavity becomes narrower, with the result that the rattling of the terminal fitting can be suppressed.

(3) Preferably, the front wall has an outer slope inclined in the same direction as the inner slope with respect to the front-rear direction on a front surface.

According to this configuration, a thickness of the front wall can be suppressed to be small as compared to a configuration in which the outer side surface of the front wall is formed at a right angle to the front-rear direction.

Further, if a mating connector is formed with a guiding surface for guiding the outer slope of the connector, the connector can be guided to a proper connection position at the time of connection to the mating connector.

(4) Preferably, the restricting portion has an inclined surface inclined rearward in a projecting direction in the closed state on a front surface.

According to this configuration, even if the terminal fitting is arranged at a position shifted rearward from a proper insertion position when the retainer portion is rotated to set the closed state, the inclined surface can press the terminal fitting forward. Thus, the closed state can be set while the terminal fitting is arranged at the proper insertion position.

(5) Preferably, the front wall covers the entire locking lance in the closed state when viewed from front.

According to this configuration, the entire locking lance can be more reliably protected against external matters from front.

Details of Embodiments of Present Disclosure

A specific example of the present disclosure is described below with reference to the drawings. Note that the present invention is not limited to these illustrations and is intended to be represented by claims and include all changes in the scope of claims and in the meaning and scope of equivalents.

Embodiment

Figure 8:
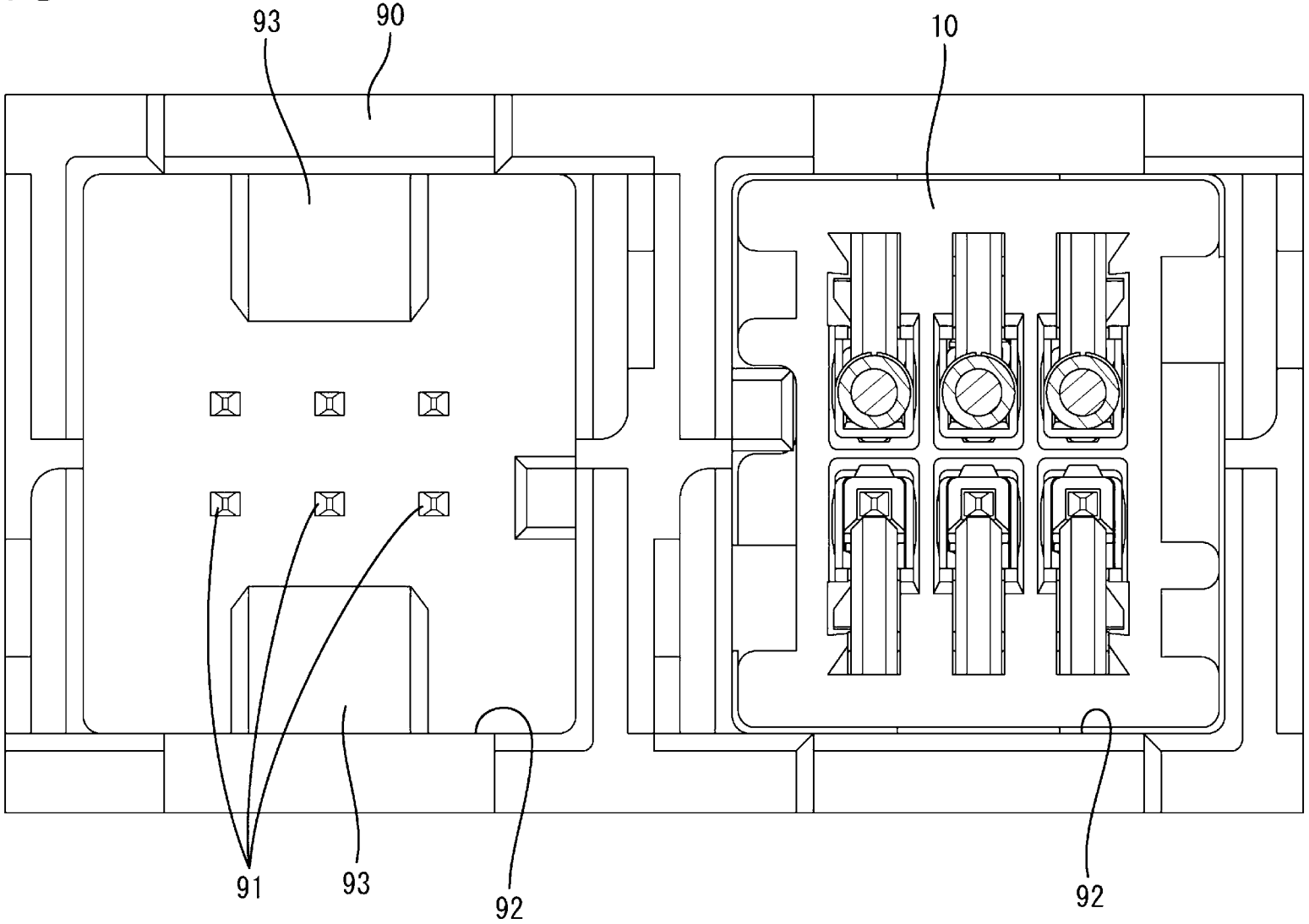
FIG. 8 is a back view of the connector connected to a mating connector.
Figure 9:
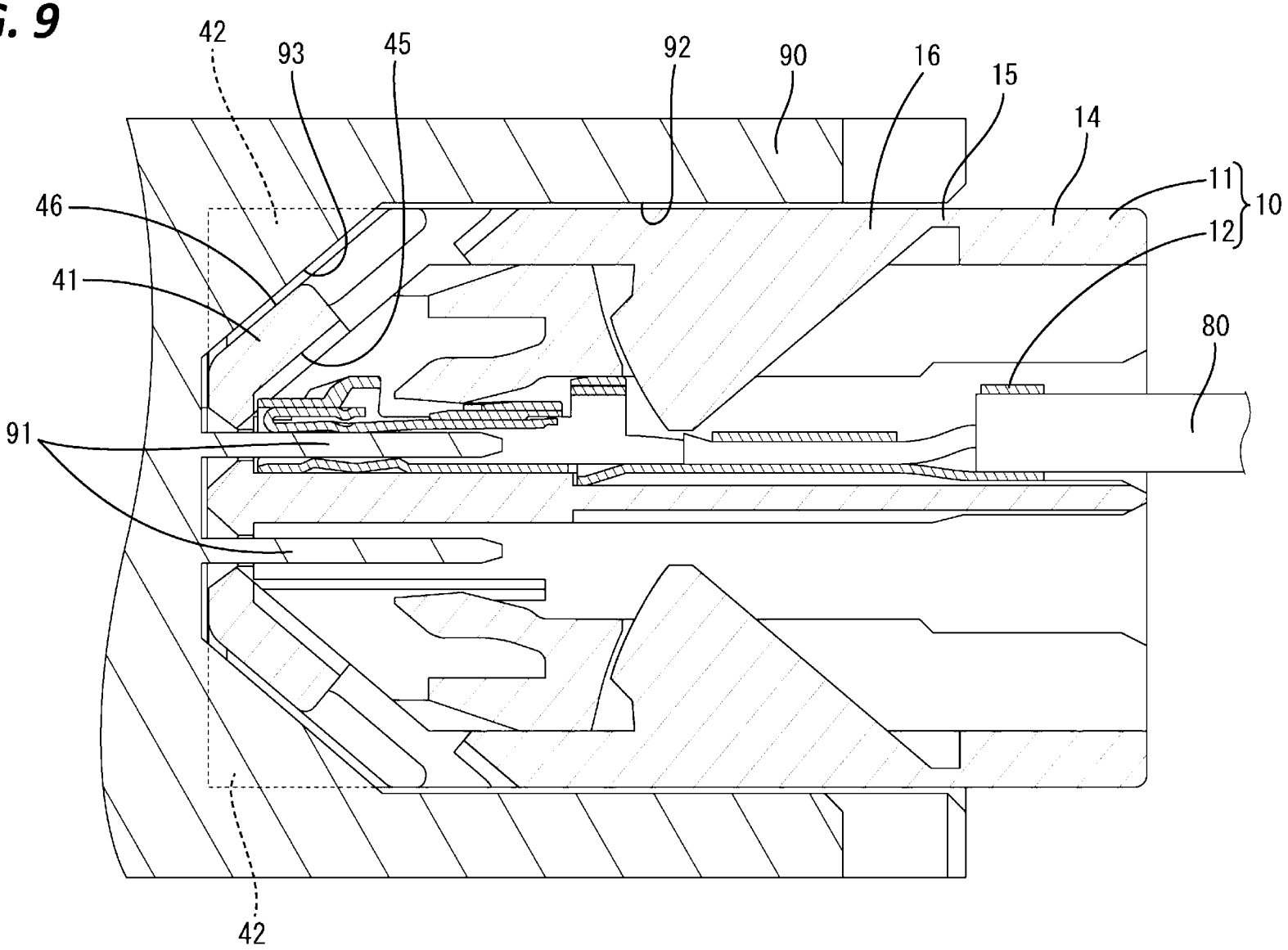
FIG. 9 is a side view in section of the connector connected to the mating connector.

A connector 10 to be connected to a mating connector 90 is illustrated in one embodiment (see FIG. 9). The mating connector 90 is, for example, provided in a device such as an instrument panel. Note that, in the following description, a side of the connector 10 facing the mating connector 90 is referred to as a front side and an opposite side thereof is referred to as a rear side. A vertical direction shown in FIGS. 2 to 9 is directly defined as a vertical direction. A lateral direction when the connector 10 is viewed from front is defined as a lateral direction.

Figure 5:
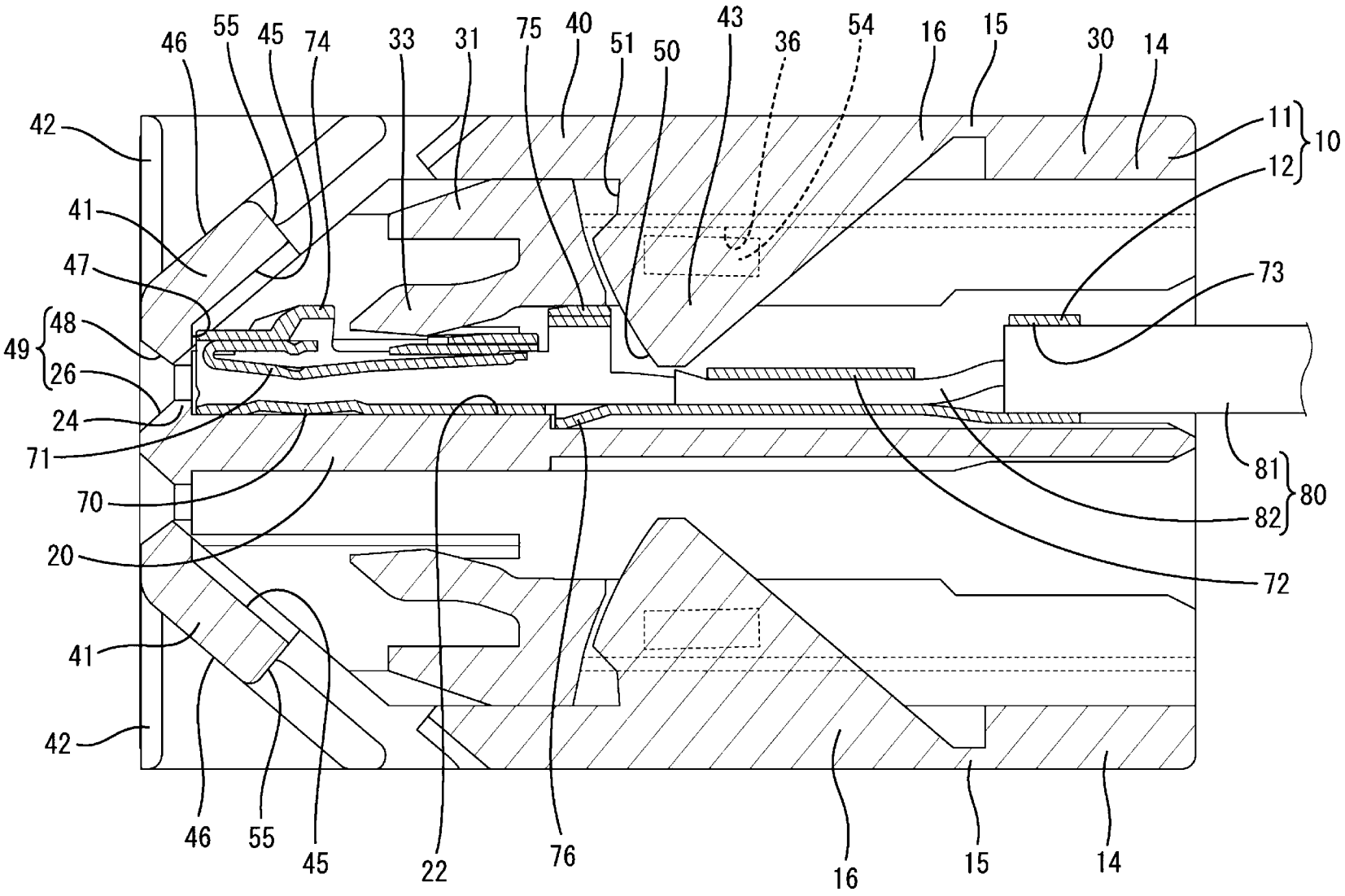
FIG. 5 is a side view in section of the connector in the closed state in the one embodiment.

As shown in FIG. 5, the connector 10 includes a housing 11 and female terminal fittings 12. The housing 11 is made of synthetic resin. As shown in FIG. 1, the housing 11 is configured as a single component including a housing body 14, hinge portions 15 and retainer portions 16. The hinge portions 15 and the retainer portions 16 are respectively provided on both upper and lower sides of the housing body 14. The retainer portions 16 on both upper and lower sides are respectively coupled to the housing body 14 via the hinge portions 15 and rotate with the hinge portions 15 as rotation center axes. The housing 11 is vertically symmetrically shaped except the shapes of left and right side surfaces. Thus, the following description is centered on an upper part of the housing 11 and components of a lower part common to the upper part are not described.

Figure 2:
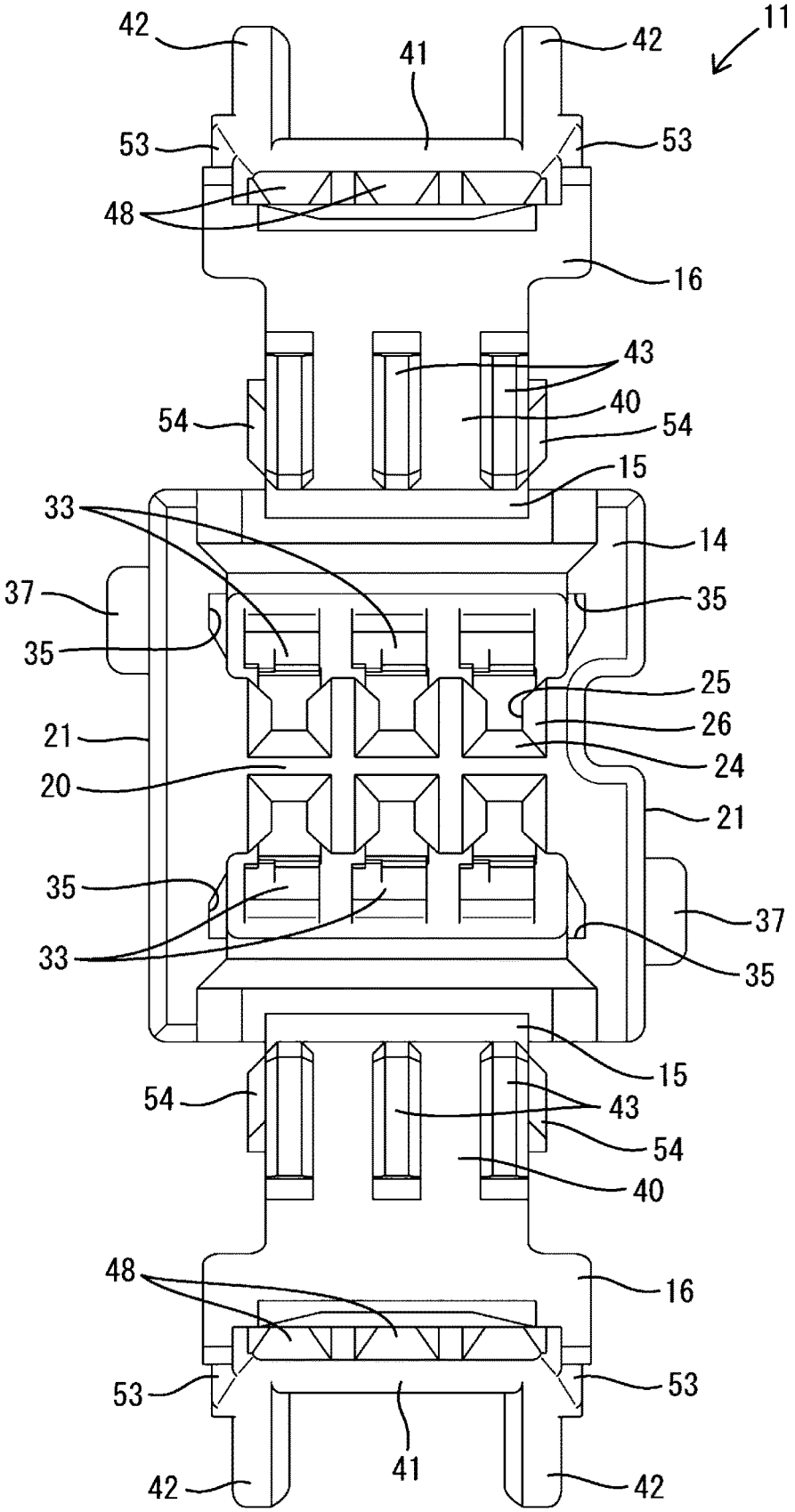
FIG. 2 is a front view of the housing in the open state in the one embodiment.

As shown in FIGS. 1 and 2, the housing body 14 has four side surfaces on the outer periphery thereof. The four side surfaces are composed of an upper surface, a lower surface and both left and right side surfaces. The housing body 14 includes a base wall portion 20 arranged in a vertical center of the housing body 14 and extending along a front-rear direction and a lateral direction. The housing 11 is vertically symmetrically shaped with this base wall portion 20 as a symmetry plane except the shapes of the left and right side surfaces. The housing body 14 includes side wall portions 21 connected to both left and right ends of the base wall portion 20 and extending in the front-rear and vertical directions. The housing body 14 includes a plurality of cavities 22 arranged above the base wall portion 20. The cavities 22 extend in the front-rear direction and are arranged side by side in the lateral direction. The terminal fitting 12 inserted from behind is arranged inside each cavity 22. The housing body 14 includes separation wall portions 23 between the cavities 22. The lower ends of the separation wall portions 23 are connected to the upper surface of the base wall portion 20. The cavities 22 are defined by the base wall portion 20, the side wall portions 21 and the separation wall portions 23.

Figure 3:
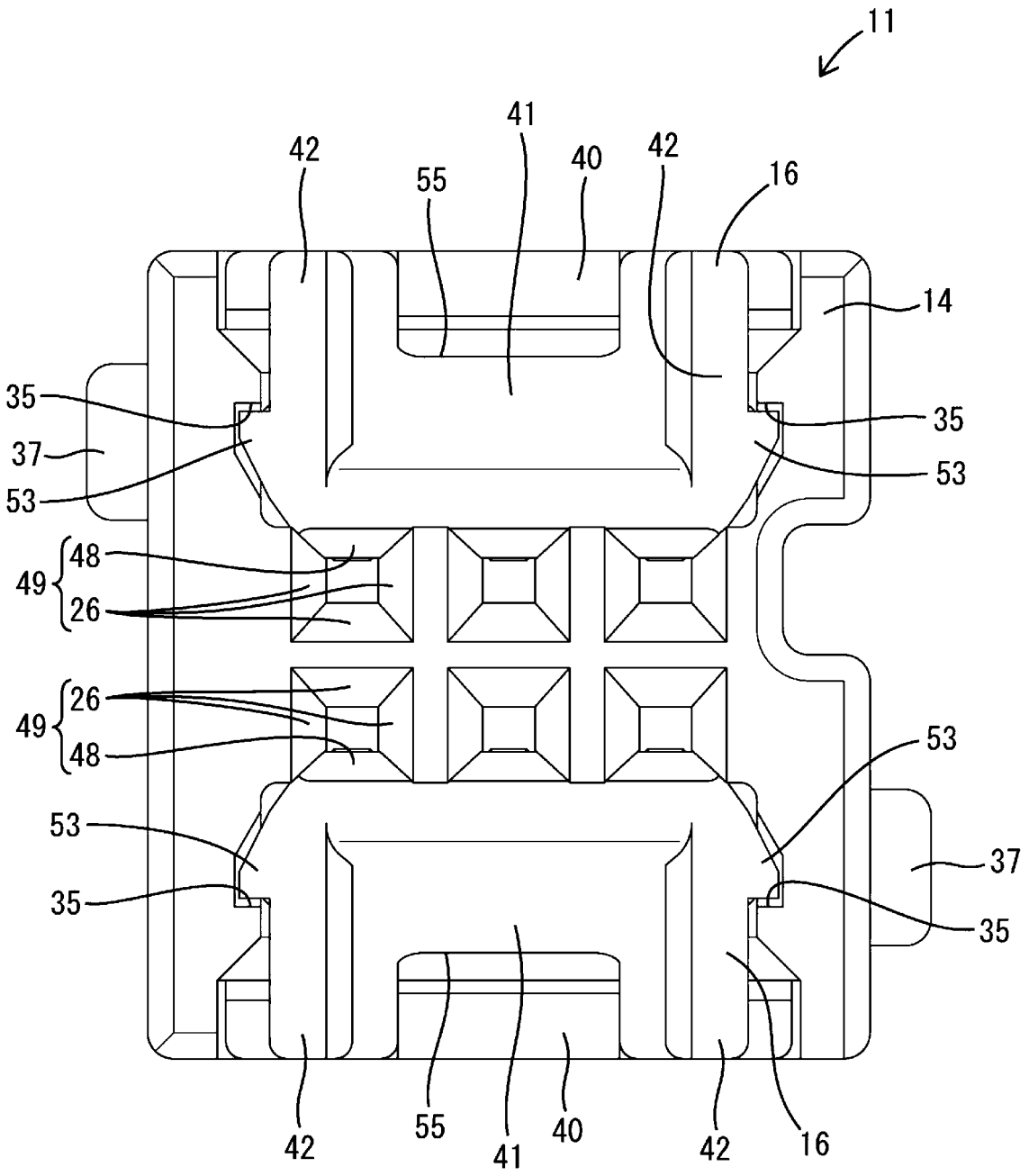
FIG. 3 is a front view of the housing in a closed state in the one embodiment.
Figure 4:
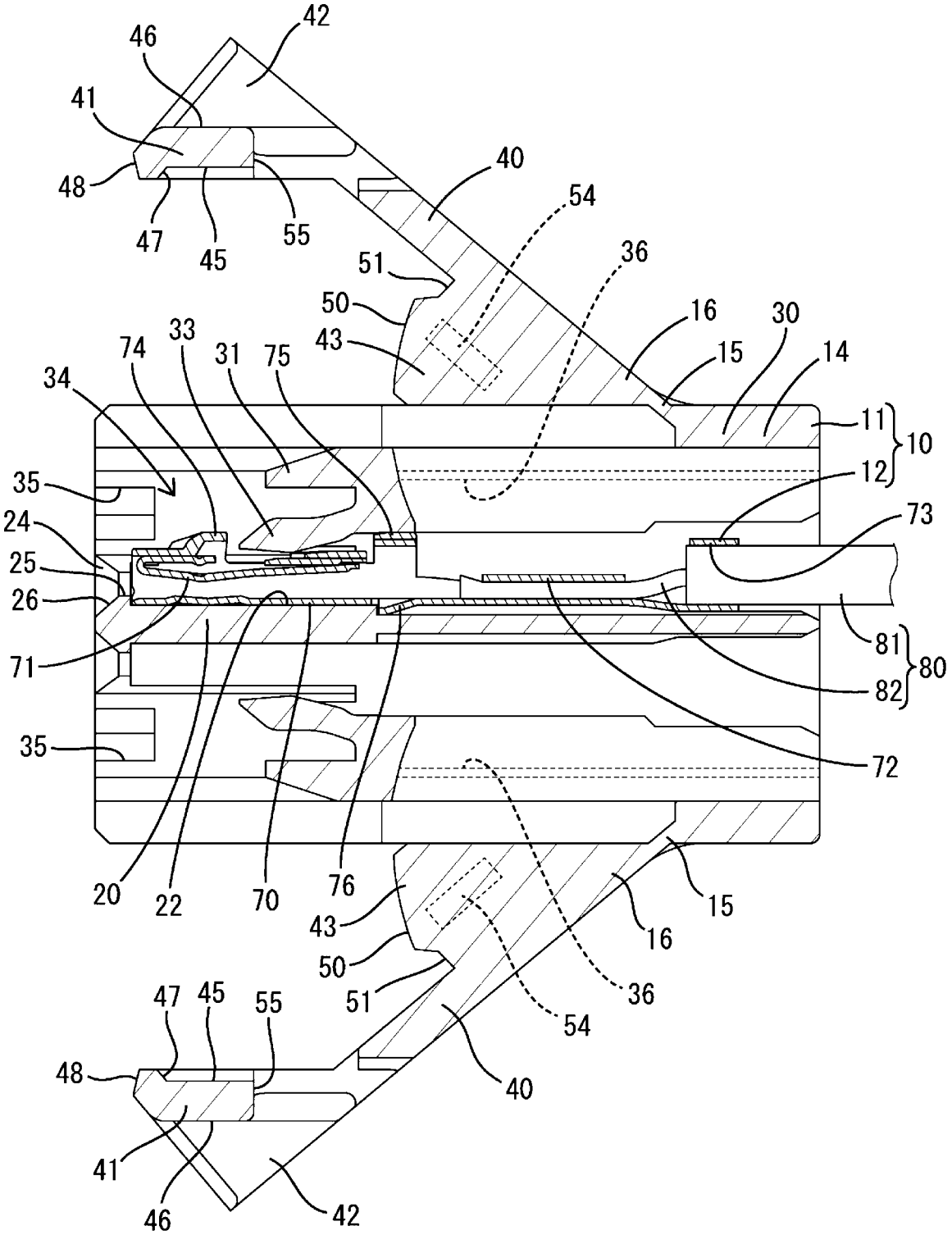
FIG. 4 is a side view in section of a connector in the open state in the one embodiment.

The housing body 14 includes a body-side front wall portion 24 in front of the cavities 22. The lower end of the body-side front wall portion 24 is connected to the base wall portion 20, and both left and right ends thereof are connected to the side wall portions 21 on both left and right sides. As shown in FIG. 4, the rear surface of the body-side front wall portion 24 faces the terminal fittings 12 arranged in the cavities 22 to restrict forward displacements of the terminal fittings 12. The body-side front wall portion 24 is formed with tab insertion openings 25 provided to correspond to the respective cavities 22. The tab insertion openings 25 are open in the front-rear direction and communicate with the cavities 22. The body-side front wall portion 24 is formed with body-side guiding surfaces 26 arranged on front sides of the tab insertion openings 25. The body-side guiding surfaces 26 are widened toward front ends. As shown in FIG. 3, the body-side guiding surfaces 26 constitute lower surfaces and both left and right surfaces of later-described guiding surfaces 49 of the housing 11. Upper surfaces of the guiding surfaces 49 are formed on the retainer portion 16.

As shown in FIGS. 1 and 4, the housing body 14 includes a first bridge portion 30 and a second bridge portion 31. The first and second bridge portions 30, 31 are respectively arranged above the cavities 22, extend in the lateral direction and are coupled to the side wall portions 21 on both left and right sides. The first bridge portion 30 is arranged in a rear end part and an upper end part of the housing body 14. The second bridge portion 31 is arranged in front of and below the first bridge portion 30. An insertion hole 32 is formed between the first and second bridge portions 30, 31. The insertion hole 32 communicates with the cavities 22 and is open in the upper surface of the housing body 14.

As shown in FIGS. 1 and 4, the housing body 14 includes locking lances 33. The locking lances 33 are arranged to project into the cavities 22. In particular, the locking lance 33 is shaped to extend downward from the lower surface of the second bridge portion 31, be bent forward and be gently inclined downward toward a front end. That is, a tip side of the locking lance 33 is deflected and deformed in the vertical direction with a base end part on the second bridge portion 31 as a fixed end. The locking lance 33 is arranged at a position not overlapping the aforementioned body-side front wall portion 24 when viewed from front. In particular, the locking lance 33 is arranged above the body-side front wall portion 24.

As shown in FIGS. 1 and 4, the housing body 14 includes, in an upper surface, an opening 34 for opening the front end sides of the cavities 29. The opening 34 is arranged in front of the second bridge portion 31 and defined by the body-side front wall portion 24, the second bridge portion 31 and the side wall portions 21 on both left and right sides. The locking lances 33 are exposed forward and upward of the housing body 14 via the opening 34.

As shown in FIGS. 1 and 4, the housing body 14 includes front lock receiving portions 35 and rear lock receiving portions 36. The front and rear lock receiving portions 35, 36 are respectively formed by recessing the inner side surfaces of the side wall portions 21 on both left and right sides. The front lock receiving portions 35 are arranged in a front end part of the housing body 14 and open forward. The rear lock receiving portions 36 are arranged in a central part in the front-rear direction of the housing body 14. The retainer portion 16 is locked to the front and rear lock receiving portions 35, 36.

As shown in FIGS. 1 and 2, the housing body 14 includes connector locking portions 37 on the outer side surfaces of the side wall portions 21 on both left and right sides.

As shown in FIG. 1, the hinge portions 15 are parts in the form of strip plates linking the housing body 14 and the retainer portion 16. A pair of left and right hinge portions 15 are provided on the upper surface of the housing body 14. The pair of hinge portions 15 are respectively integrally coupled to the front surface of a front end part of the first bridge portion 30. The upper surfaces of the pair of hinge portions 15 are connected to the upper surface of the first bridge portion 30 without any step. The rotation center axis constituted by the hinge portions 15 is oriented in the lateral direction. The hinge portions 15 are resiliently deformable. Thus, the rotation center axis of the retainer portion 16 is changeable in the vertical and front-rear directions within a deformation range of the hinge portions 15.

As shown in FIG. 1, the retainer portion 16 is integrally formed to the housing body 14 via the pair of left and right hinge portions 15. The retainer portion 16 is switched between an open state where the retainer portion 16 is not locked to the housing body 14 and a closed state where the retainer portion 16 is locked to the housing body 14 as shown in FIGS. 4 and 5 by rotating about the hinge portions 15. The retainer portion 16 includes a base plate portion 40, a front wall 41, detecting portions 42 and restricting portions 43.

As shown in FIG. 5, the base plate portion 40 has a planar shape having a rear end connected to the housing body 14 via the pair of left and right hinge portions 15 and extending along the front-rear direction in the closed state.

As shown in FIG. 5, the front wall 41 is shaped to be arranged in front of the base plate portion 40 and inclined downward toward a front side in the closed state. The front wall 41 has an inner slope 45 on a rear surface and an outer slope 46 on a front surface in the closed state. In the closed state, the inner slope 45 is shaped to be inclined downward toward the front side and closes front and upper sides of the opening 34 of the housing body 14, except a part where a later-described through hole 55 of the retainer portion 16 is formed. The inner slope 45 has a front restricting surface 47 on a front part. The front restricting surface 47 is arranged to face rearward in the closed state. Similarly to the inner slope 45, the outer slope 46 is shaped to be inclined downward toward the front side in the closed state, and arranged in parallel to the inner slope 45.

The front wall 41 has retainer-side guiding surfaces 48 arranged above the aforementioned body-side guiding surfaces 26 and inclined upward toward the front side in the closed state. The retainer-side guiding surfaces 48 constitute the guiding surfaces 49 enclosing entirely on upper, lower, left and right sides together with the body-side guiding surfaces 26 as shown in FIG. 3. As shown in FIG. 3, the front wall 41 covers the entire locking lances 33 in the closed state when viewed from front.

As shown in FIGS. 1 and 5, the detecting portions 42 are in the form of plates along the vertical direction in the closed state. The upper end surfaces of the detecting portions 42 are arranged at the same height position as the upper surface of the base plate portion 40 in the closed state. In the closed state, the detecting portions 42 extend forward from the front ends of both left and right sides of the base plate portion 40 and the front ends thereof are aligned with that of the front wall 41. The lower end surfaces of the detecting portions 42 are connected to both left and right sides of the front wall 41.

As shown in FIG. 5, the restricting portions 43 project downward into the cavities 22 from the lower surface of the base plate portion 40 in the closed state. The restricting portions 43 are provided to correspond to the respective cavities 22. The restricting portion 43 has an inclined surface 50 inclined rearward toward a lower side on a front surface. The restricting portion 43 includes a locking recess 51 recessed rearward above the inclined surface 50 on the front surface.

As shown in FIG. 1, the retainer portion 16 includes front locking portions 53 and rear locking portions 54. The front locking portions 53 are provided on the outer side surfaces of the detecting portions 42 on both left and right sides. The rear locking portions 54 are provided on the left side surface of the leftmost restricting portion 43 and the right side surface of the rightmost restricting portion 43, out of the three restricting portions 43.

As shown in FIGS. 1 and 5, the retainer portion 16 includes the through hole 55 formed between the base plate portion 40 and the front wall 41. A worker can visually confirm a locked state of the locking lances 33 and the terminal fittings 12 through the through hole 55 and release the locked state of the locking lance 33 and the terminal fitting 12 by inserting an unillustrated jig or the like into the through hole 55.

The terminal fitting 12 is formed, such as by bending a conductive metal plate. As shown in FIGS. 4 and 5, the terminal fitting 12 includes a tubular (in particular, rectangular tubular) body portion 70, a resilient contact piece 71 arranged inside the body portion 70, a wire barrel 72 and an insulation barrel 73. When the connector 10 is connected to the mating connector 90, the tab 91 of the mating connector 90 is sandwiched between the inner side surface of the body portion 70 and the resilient contact piece 71 to be electrically connected.

As shown in FIGS. 4 and 5, the wire barrel 72 and the insulation barrel 73 are arranged behind the body portion 70. The wire barrel 72 is crimped to a conductor 82 exposed from a wire 80 by removing a coating 81. The insulation barrel 73 is arranged behind the wire barrel 72 and crimped to the insulation coating 81 of the wire 80. In this way, the wire 80 is connected to the terminal fitting 12.

As shown in FIGS. 4 and 5, the terminal fitting 12 includes a first projecting portion 74, a second projecting portion 75 and a lower projecting portion 76. The first and second projecting portions 74, 75 respectively project upward with respect to the body portion 70. The first projecting portion 74 is provided on the outer peripheral surface of the body portion 70. The second projecting portion 75 is arranged behind the body portion 70. The lower projecting portion 76 is arranged behind the body portion 70 and projects downward with respect to the body portion 70.

As shown in FIGS. 8 and 9, the mating connector 90 includes a plurality of (two in this embodiment) fitting recesses 92. The tabs 91 of the mating connector 90 are exposed into the fitting recess 92 through the back surface of the fitting recess 92. The mating connector 90 includes guiding surfaces 93. The guiding surfaces 93 are arranged in laterally central parts of the upper and lower surfaces of the fitting recess 92 and inclined to be more vertically spaced apart from each other from the back surface of the fitting recess 92 toward an opening side.

Next, functions and effects of the connector 10 are described. The housing 11 is resin-molded into a shape as shown in FIGS. 1 and 2. As shown in FIG. 4, when the retainer portion 16 is in the open state, the terminal fitting 12 is inserted into the housing 11 from behind and arranged in the cavity 22. The terminal fitting 12 is inserted while deflecting a tip side of the locking lance 33 upward. When the terminal fitting 12 is arranged in the cavity 22, the locking lance 33 resiliently returns. The rear surface of the first projecting portion 74 of the terminal fitting 12 is facing the resiliently returned locking lance 33 in the front-rear direction. Thus, a rearward displacement of the terminal fitting 12 is restricted by the locking lance 33. Further, the front end of the terminal fitting 12 arranged in the cavity 22 is facing the rear surface of the body-side front wall portion 24 in the front-rear direction, and the lower projecting portion 76 is facing the front surface of a groove formed in the lower surface of the cavity 22. Thus, a forward displacement of the terminal fitting 12 is restricted.

After the terminal fittings 12 are arranged in the cavities 22, the retainer portion 16 is rotated forward with the hinge portions 15 as the rotation center axis. The respective restricting portions 43 of the retainer portion 16 are inserted into the insertion holes 32 (see FIG. 1) of the housing body 14. Then, the front and rear locking portions 53, 54 of the retainer portion 16 are resiliently locked to the front and rear lock receiving portions 35, 36 of the housing body 14, whereby the closed state is set as shown in FIG. 5.

In the closed state, the restricting portions 43 of the retainer portion 16 are arranged to project into the cavities 22. The inclined surfaces 50 of the restricting portions 43 of the retainer portion 16 are facing the rear surfaces of the second projecting portions 75 of the terminal fittings 12 in the front-rear direction. Thus, rearward escape of the terminal fittings 12 is restricted by the restricting portions 43.

Further, in the closed state, the front wall 41 of the retainer portion 16 is arranged in front of the locking lances 33. Thus, the locking lances 33 can be protected by the front wall 41 of the retainer portion 16, wherefore a front holder for protecting the locking lances 33 can be omitted. That is, the retainer portion 16 can not only function to restrict the escape of the terminal fittings 12, but also function to protect the locking lances 33. Further, since the retainer portion 16 is coupled to the housing body 14 via the hinge portions 15, the configuration of the entire connector 10 can be simplified. Further, in this connector 10, the front wall 41 of the retainer portion 16 is arranged at a position overlapping the locking lances 33 in the closed state when viewed from front. Thus, a height of the connector 10 can be suppressed to be small, with the result that the connector 10 can be reduced in size.

Further, in the closed state, the inner slope 45 of the front wall 41 in the retainer portion 16 is inclined downward toward the front side while closing a front part of the opening 34 of the housing body 14. Thus, the opening 34 of the housing body 14 can be closed by the inner slope 45 of the front wall 41, with the result that the locking lances 33 projecting into the cavities 22 can be protected. Further, since the inner slope 45 is inclined downward toward the front side, forward and upward displacements of tip parts of the terminal fittings 12 arranged inside the cavities 22 are restricted, with the result that the rattling of the terminal fittings 12 can be suppressed.

Further, the outer slope 46 of the front wall 41 is inclined in the same direction as the inner slope 45. Thus, the outer slope 46 of the front wall 41 is arranged in parallel to the inner slope 45, wherefore a thickness of the front wall 41 can be suppressed to be small as compared to a configuration in which the outer side surface of the front wall 41 is formed at a right angle to the front-rear direction.

Further, in the closed state, the front wall 41 covers the entire locking lances 33 when viewed from front. Thus, the front wall 41 can more reliably protect the entire locking lances 33 against external matters from front.

In closing the retainer portion 16, the terminal fitting 12 may be arranged at a position shifted rearward from a proper insertion position. For example, in a case shown in FIG. 6, the front surface of the restricting portion 43 of the retainer portion 16 being closed comes into contact with the second projecting portion 75 of the terminal fitting 12. As described above, the front surface of the restricting portion 43 is configured as the inclined surface 50 inclined rearward toward the lower side. Thus, in the process of closing the retainer portion 16, the inclined surface 50 of the restricting portion 43 presses the second projecting portion 75 of the terminal fitting 12 forward. Thus, the closed state can be set while the terminal fitting 12 is arranged at the proper insertion position.

Figure 6:
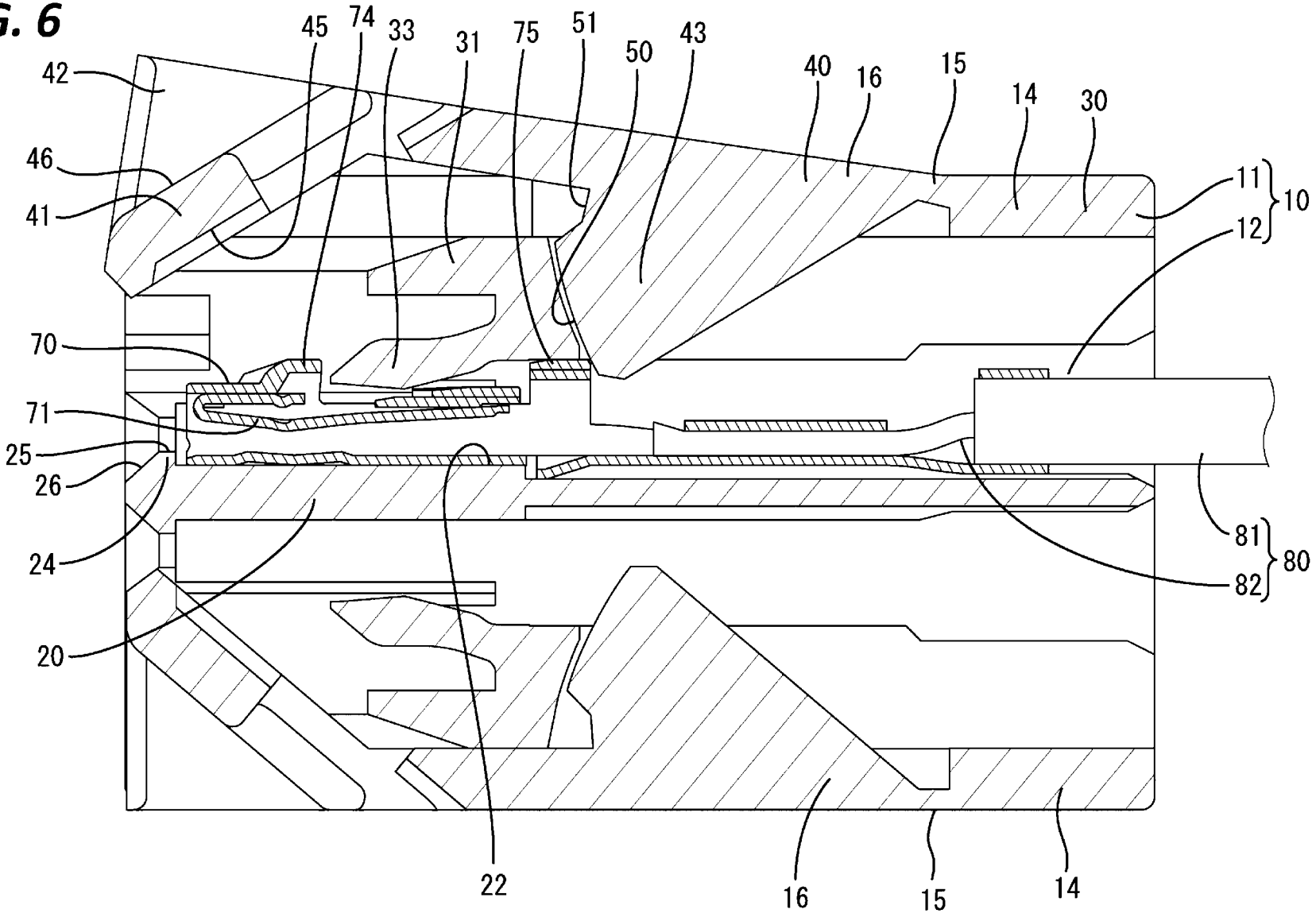
FIG. 6 is a side view in section of the connector showing a state where an inclined surface of a restricting portion of a retainer portion is in contact with a terminal fitting.
Figure 7:
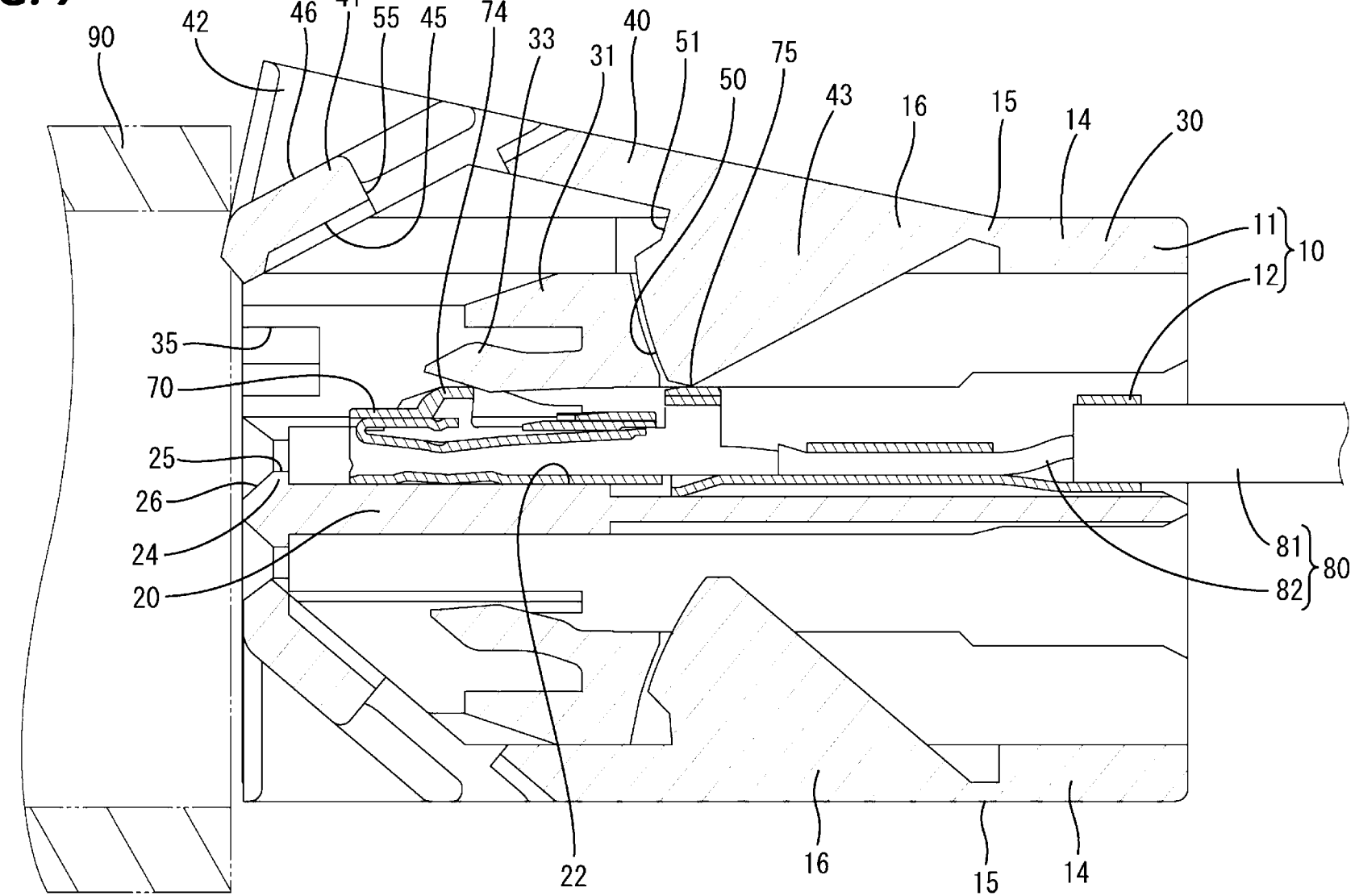
FIG. 7 is a side view in section of the connector showing a state where the restricting portion of the retainer portion is interfering with the upper surface of the terminal fitting.

Further, in a case shown in FIG. 7, the terminal fitting 12 is arranged at a position shifted further rearward than in the case shown in FIG. 6. In this case, since the restricting portion 43 of the retainer portion 16 comes into contact with the upper surface of the second projecting portion 75 of the terminal fitting 12 in closing the retainer portion 16, the terminal fitting 12 cannot be pushed forward. However, since the retainer portion 16 is lifted upward from the upper surface of the housing body 14, the retainer portion 16 easily interferes with the mating connector 90 in connecting the connector 10 to the mating connector 90. Particularly, the retainer portion 16 includes the detecting portions 42 extending further forward than the front end of the base plate portion 40. Thus, in a state where the retainer portion 16 is interfering with the terminal fitting 12, the height position of the front end of the retainer portion 16 becomes even higher. Accordingly, in connecting the connector 10 to the mating connector 90, the retainer portion 16 more reliably interferes with the mating connector 90. Therefore, it can be suppressed that the connector 10 and the mating connector 90 are connected without the terminal fittings 12 being arranged at the proper insertion positions.

The connector 10 is connected to the mating connector 90 as shown in FIGS. 8 and 9, after the terminal fittings 12 are inserted into the housing 11. In connecting the connector 10 to the mating connector 90, the outer slope 46 of the connector 10 slides along the guiding surface 93 of the mating connector 90 to be guided to a proper connection position. Thus, when the connector 10 is connected to the mating connector 90, the terminal fittings 12 of the connector 10 can be properly connected to the tabs 91 of the mating connector 90.

Other Embodiments of Present Disclosure

The embodiment disclosed this time should be considered illustrative in all aspects, rather than restrictive.

(1) Although the front wall is inclined in the closed state in the above embodiment, the front wall may not be inclined. For example, in the closed state, the front wall may be arranged along the vertical direction. That is, the inner and outer slopes may not be provided.

(2) Although the restricting portion of the retainer portion has the inclined surface inclined rearward toward the lower side on the front surface in the above embodiment, the inclined surface may not be provided. For example, the front surface of the restricting portion of the retainer portion may extend along the vertical direction or may be inclined forward toward the lower side.

(3) Although the retainer portion has the retainer-side guiding surfaces in the above embodiment, the retainer-side guiding surfaces may not be provided. Further, the retainer-side guiding surface may include the lower, left and/or right surfaces, out of the four upper, lower, left and right surfaces of the guiding surface.

(4) The front-rear direction of the connector may not be parallel to a horizontal direction (i.e. direction crossing at a right angle to gravity) during use. For example, the front-rear direction may be a direction inclined with respect to the horizontal direction or may be a vertical direction (i.e. direction of gravity).

From the foregoing, it will be appreciated that various exemplary embodiments of the present disclosure have been described herein for purposes of illustration, and that various modifications may be made without departing from the scope and spirit of the present disclosure. Accordingly, the various exemplary embodiments disclosed herein are not intended to be limiting, with the true scope and spirit being indicated by the following claims.

What is claimed is:

1. A connector, comprising:

a terminal fitting;

a housing body configured to accommodate the terminal fitting;

a retainer portion configured to openably and closably rotate with respect to the housing body; and a hinge portion coupled to the retainer portion and the housing body, the hinge portion constituting a rotation center axis of the retainer portion, wherein:

the housing body includes a cavity configured to accommodate the terminal fitting inside, a locking lance projecting into the cavity to lock the terminal fitting, and an opening configured to open a front end side of the cavity in an upper surface of the housing body, the retainer portion includes a restricting portion configured to restrict rearward escape of the terminal fitting by projecting into the cavity when the retainer portion is in a closed state with respect to the housing body, and a front wall arranged in front of the locking lance in the closed state, and the locking lance is exposed via the opening.

2. The connector of claim 1, wherein:

the front wall has, on a rear surface, an inner slope inclined with respect to a front-rear direction while closing the opening in the closed state.

3. The connector of claim 2, wherein the front wall has an outer slope inclined in the same direction as the inner slope with respect to the front-rear direction on a front surface.

4. The connector of claim 1, wherein the restricting portion has an inclined surface inclined rearward in a projecting direction in the closed state on a front surface.

5. The connector of claim 1, wherein the front wall covers the entire locking lance in the closed state when viewed from front.

6. The connector of claim 4, wherein the restricting portion further includes a locking recess recessed rearward above the inclined surface of a front surface.

7. The connector of claim 1, wherein the retainer portion further includes a base plate portion that has a planer shape having a rear end connected to the housing body via the hinge portion and extending along a front-rear direction in the closed state and a through hole formed between the base plate portion and the front wall.

* * * * *